US012747404B1

(12) United States Patent
Minchew, III et al.

(10) Patent No.: US 12,747,404 B1
(45) Date of Patent: Sep. 29, 2026

(54) FUEL BLEND COMPOSITION, SYSTEM, AND METHOD

(71) Applicant: Suburban Propane, L.P., Whippany, NJ (US)

(72) Inventors: John R. Minchew, III, Fresno, CA (US); Samuel Brown, Chino Valley, AZ (US); Antoinette Flores, Orange, CA (US)

(73) Assignee: SUBURBAN PROPANE, L.P., Whippany, NJ (US)

( * ) Notice: Subject to any disclaimer, the term of this patent is extended or adjusted under 35 U.S.C. 154(b) by 228 days.

(21) Appl. No.: 18/623,756

(22) Filed: Apr. 1, 2024

Related U.S. Application Data

(60) Provisional application No. 63/456,291, filed on Mar. 31, 2023.

(51) Int. Cl.
*C10L 1/185* (2006.01)

(52) U.S. Cl.
CPC ..... *C10L 1/1852* (2013.01); *C10L 2200/0415* (2013.01); *C10L 2290/24* (2013.01)

(58) Field of Classification Search
CPC ..... C10L 1/1852; C10L 2200/0415; C10L 2290/24
See application file for complete search history.

(56) References Cited

U.S. PATENT DOCUMENTS

2012/0201717 A1* 8/2012 Singh ..... C07C 29/1516 422/162

FOREIGN PATENT DOCUMENTS

WO WO-2023230165 A1 * 11/2023 ..... C10L 1/026

* cited by examiner

*Primary Examiner* — Ellen M Mcavoy
*Assistant Examiner* — Chantel Graham
(74) *Attorney, Agent, or Firm* — Kutak Rock LLP

(57) ABSTRACT

A blended fuel composition including a combination of liquefied petroleum gas (LPG) and dimethyl ether (DME) is provided, as well as a system for fuel blending and methods thereof. In an exemplary embodiment, a fuel blend comprises a combination of propane and renewable dimethyl ether (rDME). In an exemplary embodiment of the present invention, the fuel blend comprises about 2% to about 18% rDME by volume and about 82% to about 96% propane by volume. In an exemplary embodiment of a fuel blending system of the present invention, a blend tank is fluidically connected to a propane supply and a rDME supply. In embodiments, the fuel blending system further includes one or more loading motor to accommodate recirculation of contents of the blend tank. In embodiments, such loading motor further accommodates loading fuel from the blend tank into another tank.

16 Claims, 6 Drawing Sheets

PROPANE / DME BLEND TANK CAPACITY: 22,590.0 GWC

| BLEND RATIO | | | |
|---|---|---|---|
| 0.9600 | 0.0400 | 5.59 | 0.509 |
| PROPANE % | DME % | DME LBS/gal | PROPANE SPECIFIC GRAVITY (SG) |

| % NEEDED IN BLEND TANK | PROPANE GALLONS | DME GALLONS | LBS DME | % NEEDED IN BLEND TANK | PROPANE GALLONS | DME GALLONS | LBS DME |
|---|---|---|---|---|---|---|---|
| 5 | 1,084.3 | 45.2 | 252.6 | 50 | 10,843.2 | 451.8 | 2,525.6 |
| 10 | 2,168.6 | 90.4 | 505.1 | 51 | 11,060.1 | 460.8 | 2,576.1 |
| 11 | 2,385.5 | 99.4 | 555.6 | 52 | 11,276.9 | 469.9 | 2,626.6 |
| 12 | 2,602.4 | 108.4 | 606.1 | 53 | 11,493.8 | 478.9 | 2,677.1 |
| 13 | 2,819.2 | 117.5 | 656.6 | 54 | 11,710.7 | 487.9 | 2,727.6 |
| 14 | 3,036.1 | 126.5 | 707.2 | 55 | 11,927.5 | 497.0 | 2,778.1 |
| 15 | 3,253.0 | 135.5 | 757.7 | 56 | 12,144.4 | 506.0 | 2,828.6 |
| 16 | 3,469.8 | 144.6 | 808.2 | 57 | 12,361.2 | 515.1 | 2,879.1 |
| 17 | 3,686.7 | 153.6 | 858.7 | 58 | 12,578.1 | 524.1 | 2,929.7 |
| 18 | 3,903.6 | 162.6 | 909.2 | 59 | 12,795.0 | 533.1 | 2,980.2 |
| 19 | 4,120.4 | 171.7 | 959.7 | 60 | 13,011.8 | 542.2 | 3,030.7 |
| 20 | 4,337.3 | 180.7 | 1,010.2 | 61 | 13,228.7 | 551.2 | 3,081.2 |
| 21 | 4,554.1 | 189.8 | 1,060.7 | 62 | 13,445.6 | 560.2 | 3,131.7 |
| 22 | 4,771.0 | 198.8 | 1,111.2 | 63 | 13,662.4 | 569.3 | 3,182.2 |
| 23 | 4,987.9 | 207.8 | 1,161.8 | 64 | 13,879.3 | 578.3 | 3,232.7 |
| 24 | 5,204.7 | 216.9 | 1,212.3 | 65 | 14,096.2 | 587.3 | 3,283.2 |
| 25 | 5,421.6 | 225.9 | 1,262.8 | 66 | 14,313.0 | 596.4 | 3,333.7 |
| 26 | 5,638.5 | 234.9 | 1,313.3 | 67 | 14,529.9 | 605.4 | 3,384.3 |
| 27 | 5,855.3 | 244.0 | 1,363.8 | 68 | 14,746.8 | 614.4 | 3,434.8 |
| 28 | 6,072.2 | 253.0 | 1,414.3 | 69 | 14,963.6 | 623.5 | 3,485.3 |
| 29 | 6,289.1 | 262.0 | 1,464.8 | 70 | 15,180.5 | 632.5 | 3,535.8 |
| 30 | 6,505.9 | 271.1 | 1,515.3 | 71 | 15,397.3 | 641.6 | 3,586.3 |
| 31 | 6,722.8 | 280.1 | 1,565.8 | 72 | 15,614.2 | 650.6 | 3,636.8 |
| 32 | 6,939.6 | 289.2 | 1,616.4 | 73 | 15,831.1 | 659.6 | 3,687.3 |
| 33 | 7,156.5 | 298.2 | 1,666.9 | 74 | 16,047.9 | 668.7 | 3,737.8 |
| 34 | 7,373.4 | 307.2 | 1,717.4 | 75 | 16,264.8 | 677.7 | 3,788.3 |
| 35 | 7,590.2 | 316.3 | 1,767.9 | 76 | 16,481.7 | 686.7 | 3,838.9 |
| 36 | 7,807.1 | 325.3 | 1,818.4 | 77 | 16,698.5 | 695.8 | 3,889.4 |
| 37 | 8,024.0 | 334.3 | 1,868.9 | 78 | 16,915.4 | 704.8 | 3,939.9 |
| 38 | 8,240.8 | 343.4 | 1,919.4 | 79 | 17,132.3 | 713.8 | 3,990.4 |
| 39 | 8,457.7 | 352.4 | 1,969.9 | 80 | 17,348.1 | 722.9 | 4,040.9 |
| 40 | 8,674.6 | 361.4 | 2,020.4 | 81 | 17,566.0 | 731.9 | 4,091.4 |
| 41 | 8,891.4 | 370.5 | 2,071.0 | 82 | 17,782.8 | 741.0 | 4,141.9 |
| 42 | 9,108.3 | 379.5 | 2,121.5 | 83 | 17,999.7 | 750.0 | 4,192.4 |
| 43 | 9,325.2 | 388.5 | 2,172.0 | 84 | 18,216.6 | 759.0 | 4,242.9 |
| 44 | 9,542.0 | 397.6 | 2,222.5 | 85 | 18,433.4 | 768.1 | 4,293.5 |
| 45 | 9,758.9 | 406.6 | 2,273.0 | 86 | 18,650.3 | 777.1 | 4,344.0 |
| 46 | 9,975.7 | 415.7 | 2,323.5 | 87 | 18,867.2 | 786.1 | 4,394.5 |
| 47 | 10,192.6 | 424.7 | 2,374.0 | 88 | 19,084.0 | 795.2 | 4,445.0 |
| 48 | 10,409.5 | 433.7 | 2,424.5 | 89 | 19,300.9 | 804.2 | 4,495.5 |
| 49 | 10,626.3 | 442.8 | 2,475.1 | 90 | 19,517.8 | 813.2 | 4,546.0 |

FIG. 5

Volume Correction Factor (VCF) for rDME

| Temp. deg. F | VCF | Temp. deg. F | VCF | Temp. deg. F | VCF | Temp. deg. F | VCF | Temp. deg. F | VCF |
|---|---|---|---|---|---|---|---|---|---|
| 0 | 1.04698 | 27 | 1.02604 | 54 | 1.00477 | 81 | 0.98321 | 108 | 0.96141 |
| 1 | 1.04621 | 28 | 1.02525 | 55 | 1.00398 | 82 | 0.98240 | 109 | 0.96060 |
| 2 | 1.04544 | 29 | 1.02447 | 56 | 1.00318 | 83 | 0.98160 | 110 | 0.95979 |
| 3 | 1.04467 | 30 | 1.02369 | 57 | 1.00239 | 84 | 0.98080 | 111 | 0.95898 |
| 4 | 1.04390 | 31 | 1.02291 | 58 | 1.00159 | 85 | 0.97999 | 112 | 0.95816 |
| 5 | 1.04358 | 32 | 1.02212 | 59 | 1.00080 | 86 | 0.97919 | 113 | 0.95735 |
| 6 | 1.04236 | 33 | 1.02134 | 60* | 1.00000 | 87 | 0.97839 | 114 | 0.95653 |
| 7 | 1.04159 | 34 | 1.02055 | 61 | 0.99921 | 88 | 0.97758 | 115 | 0.95572 |
| 8 | 1.04081 | 35 | 1.01977 | 62 | 0.99841 | 89 | 0.97677 | 116 | 0.95491 |
| 9 | 1.04004 | 36 | 1.01898 | 63 | 0.99761 | 90 | 0.97596 | 117 | 0.95410 |
| 10 | 1.03926 | 37 | 1.01820 | 64 | 0.99681 | 91 | 0.97516 | 118 | 0.95328 |
| 11 | 1.03849 | 38 | 1.01741 | 65 | 0.99602 | 92 | 0.97435 | 119 | 0.95247 |
| 12 | 1.03772 | 39 | 1.01663 | 66 | 0.99522 | 93 | 0.97355 | 120 | 0.95165 |
| 13 | 1.03694 | 40 | 1.01584 | 67 | 0.99442 | 94 | 0.97274 | 121 | 0.95084 |
| 14 | 1.03616 | 41 | 1.01505 | 68 | 0.99362 | 95 | 0.97193 | 122 | 0.95002 |
| 15 | 1.03539 | 42 | 1.01426 | 69 | 0.99282 | 96 | 0.97112 | 123 | 0.94921 |
| 16 | 1.03461 | 43 | 1.01347 | 70 | 0.99202 | 97 | 0.97031 | 124 | 0.94839 |
| 17 | 1.03384 | 44 | 1.01268 | 71 | 0.99122 | 98 | 0.96950 | 125 | 0.94758 |
| 18 | 1.03306 | 45 | 1.01189 | 72 | 0.99042 | 99 | 0.96869 | 126 | 0.94676 |
| 19 | 1.03228 | 46 | 1.01110 | 73 | 0.98962 | 100 | 0.96788 | 127 | 0.94491 |
| 20 | 1.03150 | 47 | 1.01031 | 74 | 0.98882 | 101 | 0.96708 | 128 | 0.94513 |
| 21 | 1.03072 | 48 | 1.00952 | 75 | 0.98802 | 102 | 0.96627 | 129 | 0.94431 |
| 22 | 1.02994 | 49 | 1.00873 | 76 | 0.98722 | 103 | 0.96546 | 130 | 0.94349 |
| 23 | 1.02916 | 50 | 1.00794 | 77 | 0.98642 | 104 | 0.96464 | | |
| 24 | 1.02838 | 51 | 1.00715 | 78 | 0.98562 | 105 | 0.96383 | | |
| 25 | 1.02760 | 52 | 1.00635 | 79 | 0.98482 | 106 | 0.96302 | | |
| 26 | 1.02682 | 53 | 1.00556 | 80 | 0.98401 | 107 | 0.96222 | | |

* VCF not necessary

FIG. 6

FUEL BLEND COMPOSITION, SYSTEM, AND METHOD

CROSS-REFERENCE TO RELATED APPLICATIONS

This application claims priority pursuant to 35 U.S.C. 119(e) to U.S. Provisional Patent Application Ser. No. 63/456,291, filed Mar. 31, 2023, the entire disclosure of which is incorporated herein by reference.

FIELD OF THE INVENTION

The present invention relates generally to clean petroleum fuels. More specifically, the present invention is concerned with a propane and renewable dimethyl ether (rDME) blend composition and systems and methods thereof.

BACKGROUND OF THE INVENTION

The extensive and prolonged burning of fossil fuels in modern society to power industry, transportation, and electricity has led to elevated greenhouse gas emissions into the Earth's atmosphere. Such additional greenhouse gases have created added greenhouse effect, which has led to a warming of the planet and caused significant changes to climate. These changes in climate have resulted in many unintended consequences, including negative effects on various ecosystems across the globe. Accordingly, it would be beneficial to have a cleaner energy source to cut down on greenhouse gas emissions.

Furthermore, it would be beneficial to have a renewable fuel source which utilizes one or more greenhouse gas itself, or precursor(s) thereto, as feedstock. Integration of such a renewable fuel could lead to fuel usage which is closer to carbon neutrality.

Further yet, it would be beneficial to have a clean, renewable fuel which can be used in association with a variety of machines, such as but not limited to engines for motor vehicles, power plants, gas turbines, and household gas and electrical systems.

Dimethyl ether (DME) is an organic compound having the formula $CH_3OCH_3$. DME is a colorless gas which is synthetically produced and commonly used as an aerosol propellant. DME can be produced from lignocellulosic biomass, biogas, methane, shale gas, or natural gas. As used herein, renewable dimethyl ether (rDME) is DME produced from a renewal feedstock source, such as but not limited to biogas or methane from animal, food, and agricultural waste. When rDME is used on its own as fuel, it often leads to deterioration of materials used to form seals in vehicles and other gas-powered machines. Accordingly, it would be beneficial to have a fuel which utilizes a renewal fuel but which can be used with commonly-owned gas-powered machines.

Heretofore there has not been available a fuel blend composition, system, or method with the advantages and features of the present invention.

SUMMARY OF THE INVENTION

The present invention comprises a blended fuel composition including a combination of liquefied petroleum gas (LPG) and dimethyl ether (DME), a system for fuel blending, and methods thereof. In an exemplary embodiment of the present invention, a fuel blend comprises a combination of propane and renewable dimethyl ether (rDME).

In an exemplary embodiment of the present invention, the fuel blend comprises 4% rDME by volume and 96% propane by volume. In other embodiments, the fuel blend comprises alternative amounts of rDME and propane by volume, respectively, in an inverse relationship such that the combination adds up to 100%. In alternative embodiments, another liquefied petroleum gas (LPG) is substituted for propane in the fuel blend.

In an exemplary embodiment of a fuel blending system of the present invention, a blend tank is fluidically connected to a propane supply and a rDME supply. In embodiments, such propane and rDME supplies each comprise a supply tank, such as a bobtail, or supply truck and integrated supply conduits, hoses, and/or valves or any alternative direct supply configuration. In an exemplary embodiment, fluidic connections between the blend tank and propane and rDME supplies comprise conduits, a series of valves, and a pneumatic system. In an exemplary embodiment, the supply conduits include pumps, meters, and integrated control units with a connected power supply for regulating supply to the blend tank.

In an exemplary embodiment, the present fuel blending system further includes one or more blend and/or loading motors and integrated conduits and valves. In embodiments, such blend and/or loading motor(s) accommodate recirculation of contents of the blend tank. In embodiments, such blend and/or loading motor(s) accommodate loading fuel from the blend tank into another tank.

In an exemplary embodiment, a desired amount of rDME is supplied into an empty blend tank followed by a desired amount of propane supplied to the blend tank. In other embodiments, propane is supplied to the blend tank first followed by supply of rDME to the blend tank. In yet further embodiments, rDME and propane are supplied to a blend tank simultaneously.

In embodiments, the rDME and propane composition is recirculated through the blend tank for a period of time after initial combination within the tank. In other embodiments, the rDME and propane blend mixes upon initial combination, the rDME staying suspended within the propane, and is not recirculated within the blend tank.

In an embodiment of the present invention, fuel blending personnel utilize a tank strapping table for precise measurements of propane and rDME during the fuel blending process. In an exemplary embodiment, a strapping table for the present fuel blend composition provides precise amounts of the components to be blended based on: (i) the desired percentage by volume of each component, (ii) the size of the blend tank, and/or (iii) the desired fill percentage of the blend tank. In an exemplary embodiment, the strapping table values account for specific gravity (SP) and/or pounds per gallon of propane and/or rDME to be blended. In a further embodiment, a volume correction factor (VCF) is utilized in addition to the strapping table values for amounts to adjust based on the temperature of the rDME at blending.

In an embodiment, the present invention comprises a fuel composition, blending system, and blending method with lower greenhouse gas emissions than other commonly used fuels. In an embodiment, the present invention comprises, in part, a renewal fuel which utilizes one or more greenhouse gas(es) or precursor thereto as feedstock. In an embodiment, the present blended fuel comprises a fuel which is closer to carbon neutrality than other commonly used fuels. In an embodiment, the present fuel blend comprises a cleaner, partly renewable fuel which can be used in association with a variety of machines, such as but not limited to engines for motor vehicles, power plants, gas turbines, and household gas and electrical systems.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

Embodiments of the present invention are described in detail below with reference to the attached drawing figures, wherein:

FIG. 5 shows an exemplary example of a fuel blend tank strapping table of the present invention.

FIG. 6 shows an exemplary example of a volume correction factor (VCF) for rDME table of the present invention.

Figure 1:
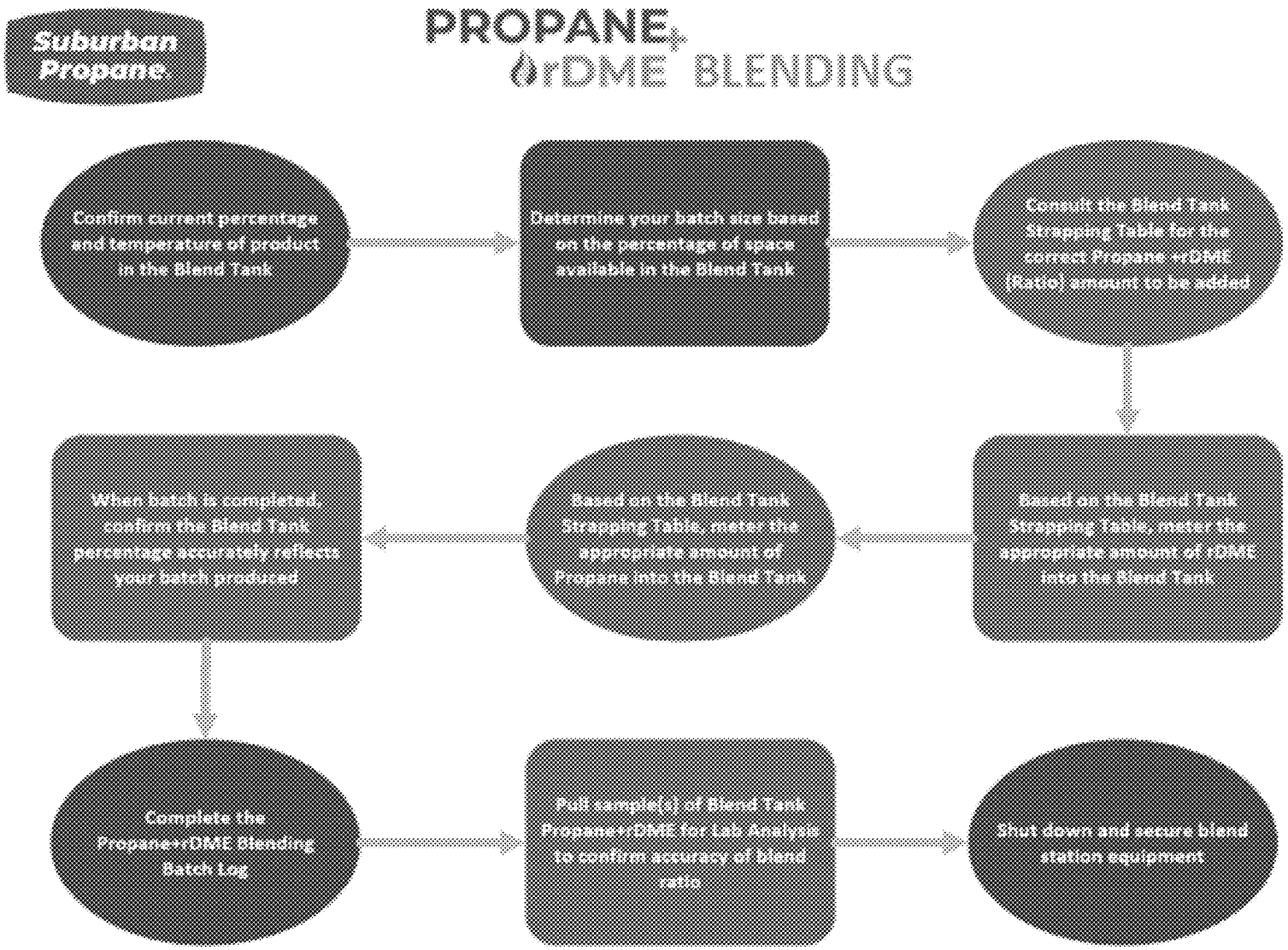
FIG. 1 is a flowchart showing steps of an embodiment of a process for blending a propane and renewable dimethyl ether (rDME) blended fuel composition of the present invention.

The drawing figures do not limit the present invention to the specific embodiments disclosed and described herein. The drawings are not necessarily to scale, emphasis instead being placed upon illustrating the principles of the invention.

DETAILED DESCRIPTION OF THE PREFERRED EMBODIMENTS

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention comprises a blended fuel composition including a combination of liquefied petroleum gas (LPG) and dimethyl ether (DME), a system for fuel blending, and methods thereof. In an exemplary embodiment of the present invention, a fuel blend comprises a combination of propane and renewable dimethyl ether (rDME).

In an exemplary embodiment of the present invention, the fuel blend comprises 4% rDME by volume and 96% propane by volume. In other embodiments, the fuel blend comprises 1%, 2%, 3%, 5%, 6%, 7%, 8%, 9%, 10%, 11%, 12%, 13%, 14%, 15%, 16%, 17%, 18%, 19%, 20%, 21%, 22%, 23%, 24%, 25%, about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, about 20%, between 2%-18%, between 3%-17%, between 4%-16%, between about 2%-about 18%, between about 3%-about 17%, between about 4%-about 16% rDME by volume with a corresponding amount of propane by volume to make up 100%. In alternative embodiments, another liquefied petroleum gas (LPG) is substituted for propane in the fuel blend, such as but not limited to butane or isobutane.

In an exemplary embodiment of a fuel blending system of the present invention, a blend tank is fluidically connected to a propane supply and a rDME supply. In embodiments, such propane and rDME supplies each comprise a supply tank, such as a bobtail, or supply truck and integrated supply conduits, hoses, and/or valves or any alternative direct supply configuration. In an exemplary embodiment, fluidic connections between the blend tank and propane and rDME supplies comprise conduits, a series of valves, and a pneumatic system. In embodiments, such conduits are made up of PVC or metal piping. In an exemplary embodiment, the present system includes both liquid and vapor supply conduits.

In an exemplary embodiment, the supply conduits include pumps, meters, and integrated control units with a connected power supply for regulating the supply to the blend tank. Such power supply may include solar power modules or alternative electric power supply via alternating current or direct current.

In an exemplary embodiment, the present fuel blending system further includes one or more blend and/or loading motors and integrated conduits and valves. In embodiments, such blend and/or loading motor(s) accommodate recirculation of contents of the blend tank. In embodiments, such blend and/or loading motor(s) accommodate loading fuel from the blend tank into another tank.

Figure 4:
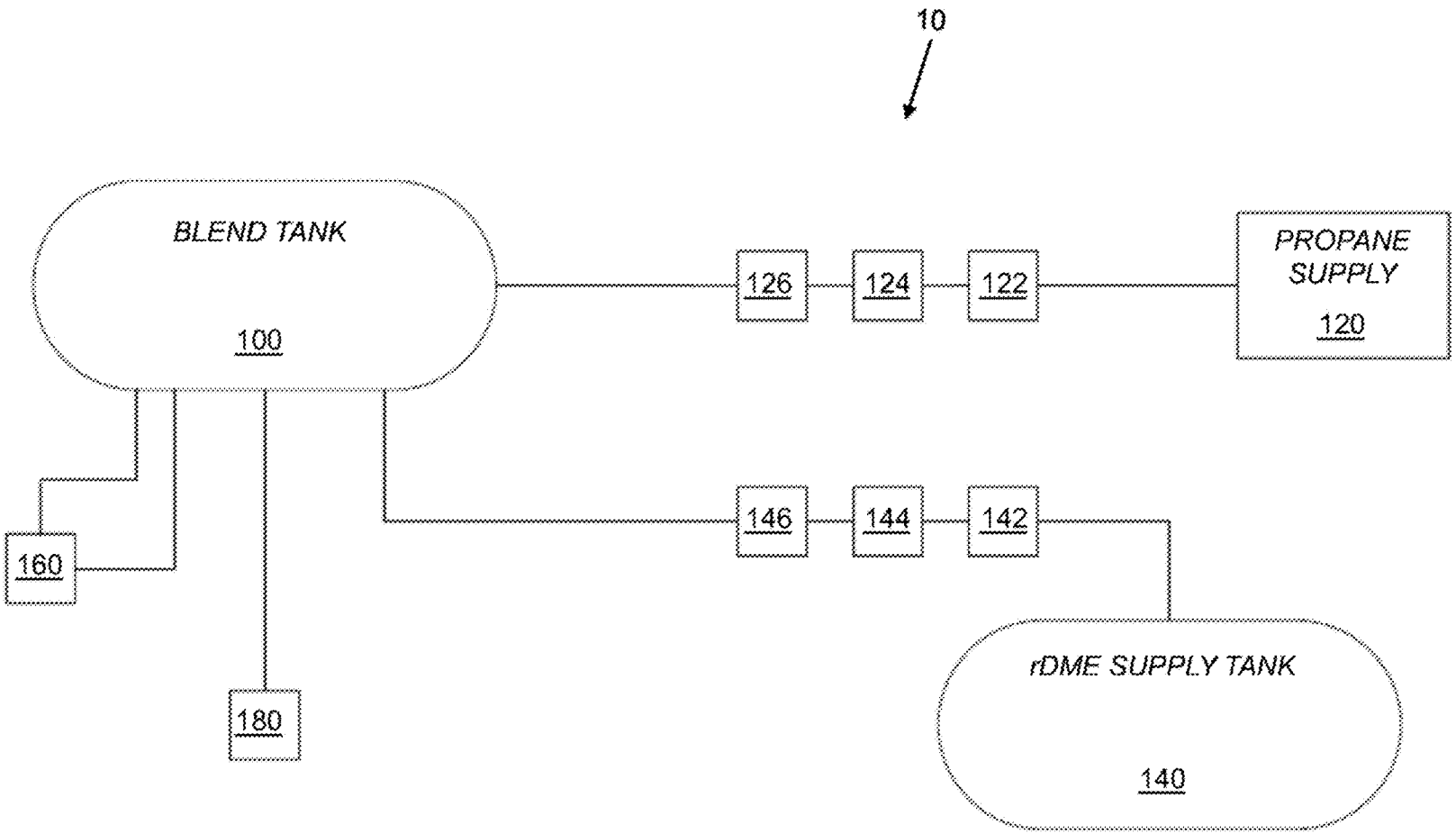
FIG. 4 shows a simple schematic drawing of an embodiment of a propane and rDME fuel blending system of the present invention.

FIG. 4 shows a simple schematic diagram of an exemplary embodiment of a fuel blending system 10 of the present invention, including a blend tank 100 fluidically connected to a propane supply 120, a rDME supply tank 140, a blend or loading pump 160, and a bulkhead connector 180. The system further includes a propane supply control unit 122, pump 124, and flow meter 126 and a rDME supply control unit 142, pump 144, and flow meter 126. In an exemplary embodiment, the control units are electrically connected to the supply pumps for controlling flow of the propane and rDME into the blend tank. The system further comprises a series of valves, including but not limited to directional valves, check valves, safety relief valves, and bypass valves; switches; additional conduits; a pneumatic system; emergency shut offs; and connection to a power supply, which are not shown in FIG. 4.

In an exemplary embodiment, a desired amount of rDME is supplied into an empty blend tank followed by desired amount of propane supplied to the blend tank. In other embodiments, propane is supplied to the blend tank first followed by supply of rDME to the blend tank. In yet further embodiments, rDME and propane are supplied to a blend tank simultaneously.

Figure 2:
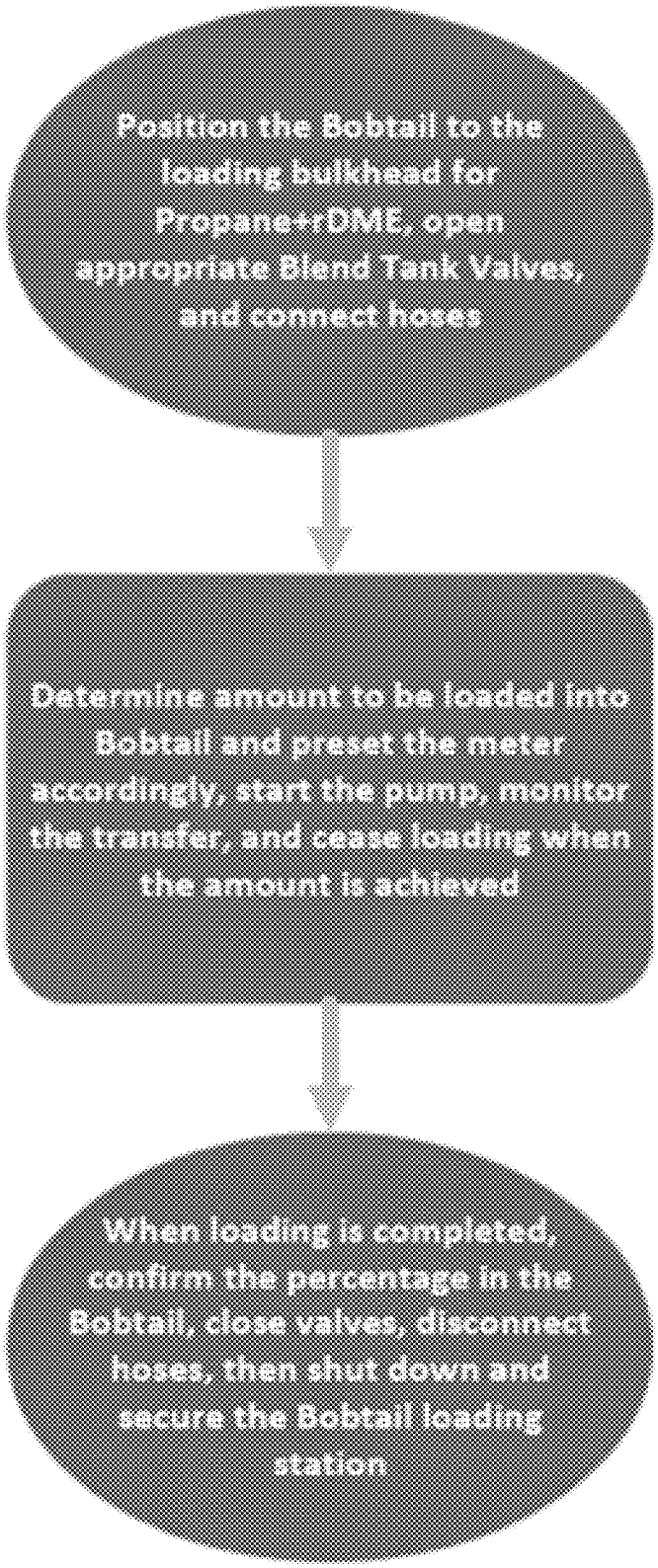
FIG. 2 is a flowchart showing steps of an embodiment of a process of loading a bobtail with a propane and rDME blended fuel of the present invention.
Figure 3:
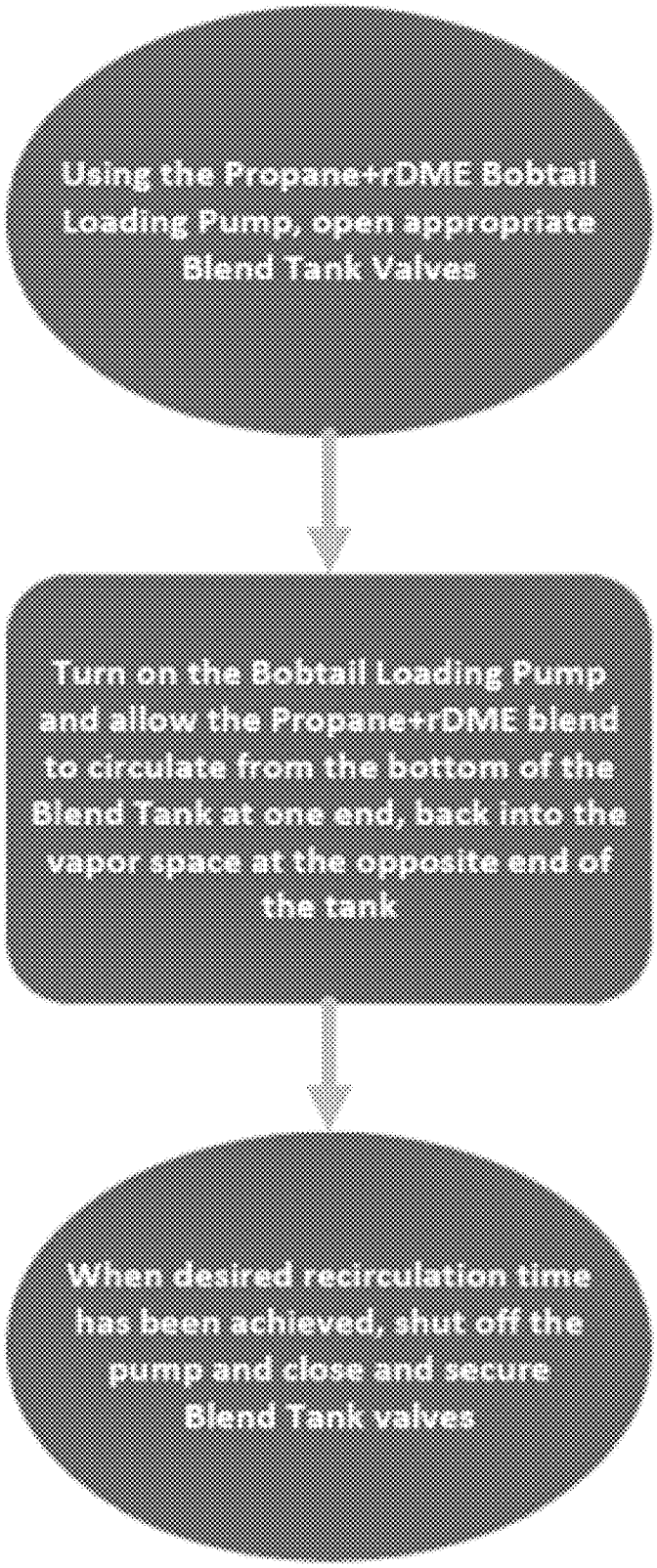
FIG. 3 is a flowchart showing steps of an embodiment of a process of recirculating a propane and rDME blended fuel within a blend tank of the present invention.

FIG. 1 illustrates an exemplary embodiment of a process for blending a propane and rDME fuel blend of the present invention. FIG. 2 shows an exemplary embodiment of loading the propane and rDME fuel blend composition of the present invention into a bobtail tank for transport and/or storage. FIG. 3 shows an exemplary embodiment of a process for recirculating the contents of the blend tank via a blend or loading pump.

In embodiments, the rDME and propane composition is recirculated through the blend tank for a period of time after initial combination within the tank. In other embodiments, the rDME and propane blend mixes upon initial combination, the rDME staying suspended within the propane, and is not recirculated within the blend tank. In embodiments, the rDME and propane composition is recirculated for about one minute, about two minutes, about three minutes, about four minutes, about five minutes, about six minutes, about seven minutes, about eight minutes, about nine minutes, about 10 minutes, about 11 minutes, about 12 minutes, about 13 minutes, about 14 minutes, about 15 minutes, about 20 minutes, about 25 minutes, about 30 minutes, about 35 minutes, about 40 minutes, about 45 minutes, about 50 minutes, about 55 minutes, about 1 hour, about 1.25 hours, about 1.5 hours, about 1.75 hours, or about 2 hours.

In an exemplary embodiment, the rDME and propane composition is recirculated at a rate of one minute per 150 gallons of fuel product. In further embodiments the rDME and propane blended fuel composition is recirculated at a rate of one minute per 50 gallons, 75 gallons, 100 gallons, 125 gallons, 175 gallons, 200 gallons, 225 gallons, 250 gallons, 275 gallons, 300 gallons, 350 gallons, 400 gallons, 450 gallons, 500 gallons, 550 gallons, 600 gallons, 650 gallons, 700 gallons, 750 gallons, 800 gallons, 850 gallons, 900 gallons, 950 gallons, 1,000 gallons, about 50 gallons, about 75 gallons, about 100 gallons, about 125 gallons, about 150 gallons, about 175 gallons, about 200 gallons, about 225 gallons, about 250 gallons, about 275 gallons, about 300 gallons, about 350 gallons, about 400 gallons, about 450 gallons, about 500 gallons, about 550 gallons, about 600 gallons, about 650 gallons, about 700 gallons, about 750 gallons, about 800 gallons, about 850 gallons, about 900 gallons, about 950 gallons, or about 1,000 gallons of fuel product.

In alternative embodiments, synthetic, non-renewable dimethyl ether (DME) or a combination of synthetic, non-renewable DME and renewable DME is used as a component of a blended petroleum fuel in place of rDME as described above. In further alternative embodiments, one or more other liquefied petroleum gases (LPGs), such as but not limited to propylene, butylene, isobutane, and n-butane, are used in place of or in combination with propane in a blend with DME as described herein.

In an exemplary embodiment of a method of the present invention, a blend tank pneumatic system switch is opened, and an rDME pneumatic actuator switch is activated. A blend tank internal valves actuator is activated, and supply valves from an rDME supply tank are opened to an rDME meter. The rDME meter register(s) are energized and activated. The rDME meter is set to a desired rDME amount (in gallons in a preferred embodiment) to be delivered to the blend tank. An rDME supply pump is started. In a preferred embodiment, flow of rDME can be confirmed by looking through a sight glass of a backflow check valve in a supply conduit. In an exemplary embodiment, the rDME meter slows and stops flow of rDME at the preset, desired amount. The rDME pump is shut off and the rDME supply valves and rDME pneumatic actuator are closed. Power is shut off to the rDME meter register(s).

Next, propane supply valves from one or more propane storage tanks to a propane meter are opened. The propane meter register(s) are energized and activated. The propane meter is set to a desired propane amount (in gallons in a preferred embodiment) to be delivered to the blend tank. A propane supply pump is started. In a preferred embodiment, flow of propane can be confirmed by looking through a sight glass of a backflow check valve in a supply conduit. In an exemplary embodiment, the propane meter slows and stops flow of propane at the preset, desired amount. The propane pump is shut off and the propane supply valves are closed. Power is shut off to the propane meter register(s).

In an exemplary embodiment of a method of recirculation of the present invention, blend tank bobtail loading and recirculation valves are opened. A blend pump is started, and the contents of the blend tank (i.e., the blended fuel product) are recirculated for a desired period of time. After the desired period of time, the blend pump is shut off and the loading and recirculation valves are closed. The pneumatic actuator switches are closed. In a preferred embodiment, the blend tank internal valves are confirmed to be closed.

In an exemplary embodiment of a method of loading a blended fuel product from into a bobtail of the present invention, pneumatic actuator switches and bobtail loading valves are opened. Liquid and vapor transfer hoses are connected from a blend tank bobtail loading bulkhead to bobtail connections. Bulkhead emergency shutoff valves (ESVs) are opened. Liquid and vapor transfer hose-end valves and appropriate liquid and vapor valves in the bobtail's conduits are opened. A blend tank loading meter is energized and activated. The loading meter is set to a desired amount (in gallons in a preferred embodiment) of the blended fuel product to be loaded into the bobtail. A loading pump is started. The loading meter slows and stops flow of the blended fuel product at the preset, desired amount. The loading pump is shut off, and the pneumatic actuator switches are closed. The bulkhead ESVs are confirmed to be disengaged. The bobtail loading valves are closed, and the liquid and vapor hose-end valves are closed. A vapor equalization hose is bled off and disconnected from the bobtail connection. A liquid hose is bled off and disconnected from the bobtail connection. Power is shut off to the loading meter register(s).

In an embodiment of the present invention, fuel blending personnel utilize a tank strapping table for precise measurements of propane and rDME during the fuel blending process. An exemplary example of a strapping table for an embodiment of the present invention is shown in FIG. 5. In an exemplary embodiment, a strapping table for the present fuel blend composition provides precise amounts of the components to be blended based on: (i) the desired percentage by volume of each component, (ii) the size of the blend tank, and/or (iii) the desired fill percentage of the blend tank. In an exemplary embodiment, the strapping table values account for specific gravity (SP) and/or pounds per gallon of propane and/or rDME to be blended.

In a further embodiment, a volume correction factor (VCF) is utilized in addition to the strapping table values for amounts of rDME to adjust based on the temperature of the rDME at blending. An exemplary example of a VCF table for rDME for one embodiment of the present invention is shown in FIG. 6.

Certain terminology is used in the description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Forwardly and rearwardly are generally in reference to the direction of travel, if appropriate. Additionally, anatomical terms are given their usual meanings. For example, proximal means closer to the trunk of the body, and distal means further from the trunk of the body. Said terminology shall include the words specifically mentioned, derivatives thereof, and words of similar meaning.

As used in this specification and the appended claims, the singular forms "a", "an", and "the" include plural references unless the context clearly dictates otherwise. Thus, for example, a reference to "a method" includes one or more methods, elements, and/or steps of the type described herein and/or which will become apparent to those persons skilled in the art upon reading this disclosure and so forth.

As used in this specification and the appended claims, the use of the term "about" means a range of values including and within 15% above and below the named value, except for nominal temperature. For example, the phrase "about 3 mM" means within 15% of 3 mM, or 2.55-3.45, inclusive. Likewise, the phrase "about 3 millimeters (mm)" means 2.55 mm-3.45 mm, inclusive. When temperature is used to denote change, the term "about" means a range of values including and within 15% above and below the named value. For example, "about 5° C.," when used to denote a change such as in "a thermal resolution of better than 5° C. across 3 mm," means within 15% of 5° C., or 4.25° C.-5.75° C. When referring to nominal temperature, such as "about −50° C. to about +50° C.," the term "about" means ±5° C. Thus, for example, the phrase "about 37° C." means 32° C.-42° C.

Unless defined otherwise, all technical and scientific terms used herein have the same meaning as commonly understood by one of ordinary skill in the art to which this invention belongs. Although any systems, elements, methods and materials similar or equivalent to those described herein can be used in the practice or testing of the present invention, the preferred systems, elements, and methods and materials are now described. All publications mentioned herein are incorporated herein by reference to describe in their entirety.

"Substantially" means to be more-or-less conforming to the particular dimension, range, shape, concept, or other aspect modified by the term, such that a feature or component need not conform exactly. For example, a "substantially cylindrical" object means that the object resembles a cylinder but may have one or more deviations from a true cylinder. "Comprising," "including," and "having" (and conjugations thereof) are used interchangeably to mean including but not necessarily limited to, and are open-ended terms not intended to exclude additional, unrecited elements or method steps.

Changes may be made in the above methods, devices and structures without departing from the scope hereof Many different arrangements of the various components depicted, as well as components not shown, are possible without departing from the spirit and scope of the present invention. Embodiments of the present invention have been described with the intent to be illustrative and exemplary of the invention, rather than restrictive or limiting of the scope thereof. Alternative embodiments will become apparent to those skilled in the art that do not depart from its scope. Specific structural and functional details disclosed herein are not to be interpreted as limiting, but merely as a representative basis for teaching one of skill in the art to employ the present invention in any appropriately detailed structure. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

It is also to be understood that the following claims are intended to cover all of the generic and specific features of the invention herein described, and all statements of the scope of the invention which, as a matter of language, might be said to fall therebetween.

Having thus described the invention, what is claimed as new and desired to be secured by Letters Patent is:

1. A blended fuel composition comprising:

an amount of dimethyl ether (DME) between about 2 percent to about 18 percent by total volume of the blended fuel composition; and an amount of liquefied petroleum gas (LPG) between about 82 percent to about 98 percent by total volume of the blended fuel composition;

wherein said amount of DME and said amount of LPG add up to 100 percent by total volume of the blended fuel composition.

2. The blended fuel composition of claim 1, wherein said amount of LPG comprises an amount of propane.

3. The blended fuel composition of claim 1, wherein said amount of DME comprises an amount of renewable dimethyl ether (rDME).

4. The blended fuel composition of claim 1, wherein:

said amount of DME comprises about 4 percent by total volume of the blended fuel composition; and said amount of LPG comprises about 96 percent by total volume of the blended fuel composition.

5. A method of blending a blended fuel composition comprising dimethyl ether (DME) and liquefied petroleum gas (LPG), the method comprising the steps of:

supplying an amount of dimethyl ether (DME) between about 2 percent to about 18 percent by total volume of the blended fuel composition into a blend tank from a DME supply tank; and supplying an amount of liquefied petroleum gas (LPG) between about 82 percent to about 98 percent by total volume of the blended fuel composition into said blend tank from a LPG source;

wherein said amount of DME and said amount of LPG add up to 100 percent by total volume of the blended fuel composition.

6. The method of claim 5, further comprising the step of:

circulating said blended fuel composition within said blend tank via a loading pump.

7. The method of claim 5, wherein said amount of LPG comprises an amount of propane.

8. The method of claim 5, wherein said amount of DME comprises an amount of renewable dimethyl ether (rDME).

9. The method of claim 8, further comprising the step of:

obtaining a supply of said rDME produced from a renewable feedstock.

10. The method of claim 5, wherein:

said amount of DME comprises about 4 percent by total volume of the blended fuel composition; and said amount of LPG comprises about 96 percent by total volume of the blended fuel composition.

11. A system for blending a blended fuel composition comprising dimethyl ether (DME) and liquefied petroleum gas (LPG), the system comprising:

a blend tank fluidically connected to a supply of LPG;

a DME supply tank configured to hold an amount of DME and fluidically connected to said blend tank;

a loading pump fluidically connected to said blend tank and configured to accommodate circulation of a liquid composition within said blend tank; and a loading bulkhead fluidically connected to said blend tank and configured for connection to a transport tank to be loaded.

12. The system of claim 11, further comprising:

a first supply pump and a first flow meter positioned between said supply of LPG and said blend tank;

a second supply pump and a second flow meter positioned between said DME supply tank and said blend tank; and a controller electrically connected to said first and second supply pumps and to a power source and configured for controlling flow of said LPG and said DME into said blend tank.

13. The system of claim 11, wherein said supply of LPG comprises a supply of propane.

14. The system of claim 11, wherein said amount of DME comprises an amount of renewable dimethyl ether (rDME).

15. The system of claim 11, further comprising a plurality of safety relief valves.

16. The system of claim 11, further comprising a pneumatic system.

* * * * *